United States Patent [19]

Jordan

[11] Patent Number: 4,988,031

[45] Date of Patent: Jan. 29, 1991

[54] HAND TOOL FOR INSTALLING AND REMOVING RIVETS

[76] Inventor: David J. Jordan, 2505 W. Iola, Broken Arrow, Okla. 74012

[21] Appl. No.: 461,330

[22] Filed: Jan. 5, 1990

[51] Int. Cl.[5] ..... B25C 11/00

[52] U.S. Cl. ..... 227/63; 72/412; 59/7; D8/51

[58] Field of Search ..... D8/51; 29/283, 256, 29/252, 243, 53, 243.54, 243.55; 72/412, 391, 472, 477, 479, 459; 59/7; 227/63

[56] References Cited

U.S. PATENT DOCUMENTS

| | | | |
|---|---|---|---|
| 594,806 | 11/1897 | Mckenney | 227/63 |
| 3,230,751 | 1/1966 | Smith . | |
| 3,234,634 | 2/1966 | Johnson et al. . | |
| 3,412,597 | 11/1968 | Ross . | |
| 4,602,414 | 7/1986 | Bartholomew et al. | 227/156 X |
| 4,693,406 | 9/1987 | Bartholomew et al. | 227/63 |

*Primary Examiner*—Timothy V. Eley

[57] ABSTRACT

A hand tool is disclosed for installing mallable rivets into a workpiece and for removing such rivets. The hand tool comprises a generally C-shaped body that has a clamp sleeve and a coaxially rivet forming member extending towards a coaxially located punch member. A workpiece is placed between the clamp sleeve and the punch member and the clamp secures the workpiece against the punch member. If a rivet is to be removed, the rivet forming member is retracted and the punch member is advanced to remove a rivet. If a rivet is to be installed, the punch member is partially retracted and the head of the rivet is rested thereon, then the rivet forming member is advanced against an end portion of the rivet extending from the opposite side of the workpiece.

7 Claims, 3 Drawing Sheets

HAND TOOL FOR INSTALLING AND REMOVING RIVETS

BACKGROUND OF THE INVENTION

1. Field of the Invention

The present invention relates to hand tools used for riveting and, more particularly, to such hand tools which can be used by a single operator to install and remove rivets, pins in roller chain, etc.

2. Description of the Prior Art

In the well known trade of securing one metal member to another, rivets are passed through both metal members which are secured by the deformation of a shank of the rivet Various industries use riveting, and one in particular has found that riveting is useful to secure sickle sections to a cutter bar of a farm implement. This industrial use requires the use of hand tools by a single operator to remove and/or install rivets.

A typical riveting tool of the type above described is described in U.S. Pat. No. 3,230,751. Further, a typical rivet removal tool, usually called a punch, is described in U.S. Pat. No. 3,412,597. If an operator needed to remove one or more rivets, as well as install rivets, then two separate tools would be needed. One tool that combined both the installation and removal capability is described in U.S. Pat. No. 3,234,634. A problem with the use of the tool described in '634 is that it requires two separate but complete rivet handling mechanisms, adding weight and cost to the hand tool, and there is no independent clamping mechanism for either the punch or the rivet forming portion to secure and center the workplace therebetween.

SUMMARY OF THE INVENTION

The present invention has been contemplated to overcome the foregoing deficiencies and meet the above-described needs. Specifically, the present invention comprises a hand tool for both installing and removing mallable rivets that combines the beneficial features of punches and rivet formers in a weight reducing, size reducing and cost reducing manner. A generally C-shaped body has a clamp sleeve extending through a bore in one leg portion of the body, and has a punch member extendable through a coaxial bore in a second leg portion of the body. A rivet forming member extends through the clamp sleeve so that a single clamp is needed for both rivet installation and removal. Further, an inner end of the punch member acts as an anvil during rivet forming and an inner end of the rivet forming member can be retracted to permit the coaxially aligned punch to force out and remove a rivet.

DETAILED DESCRIPTION OF THE PREFERRED EMBODIMENTS

Figure 1:
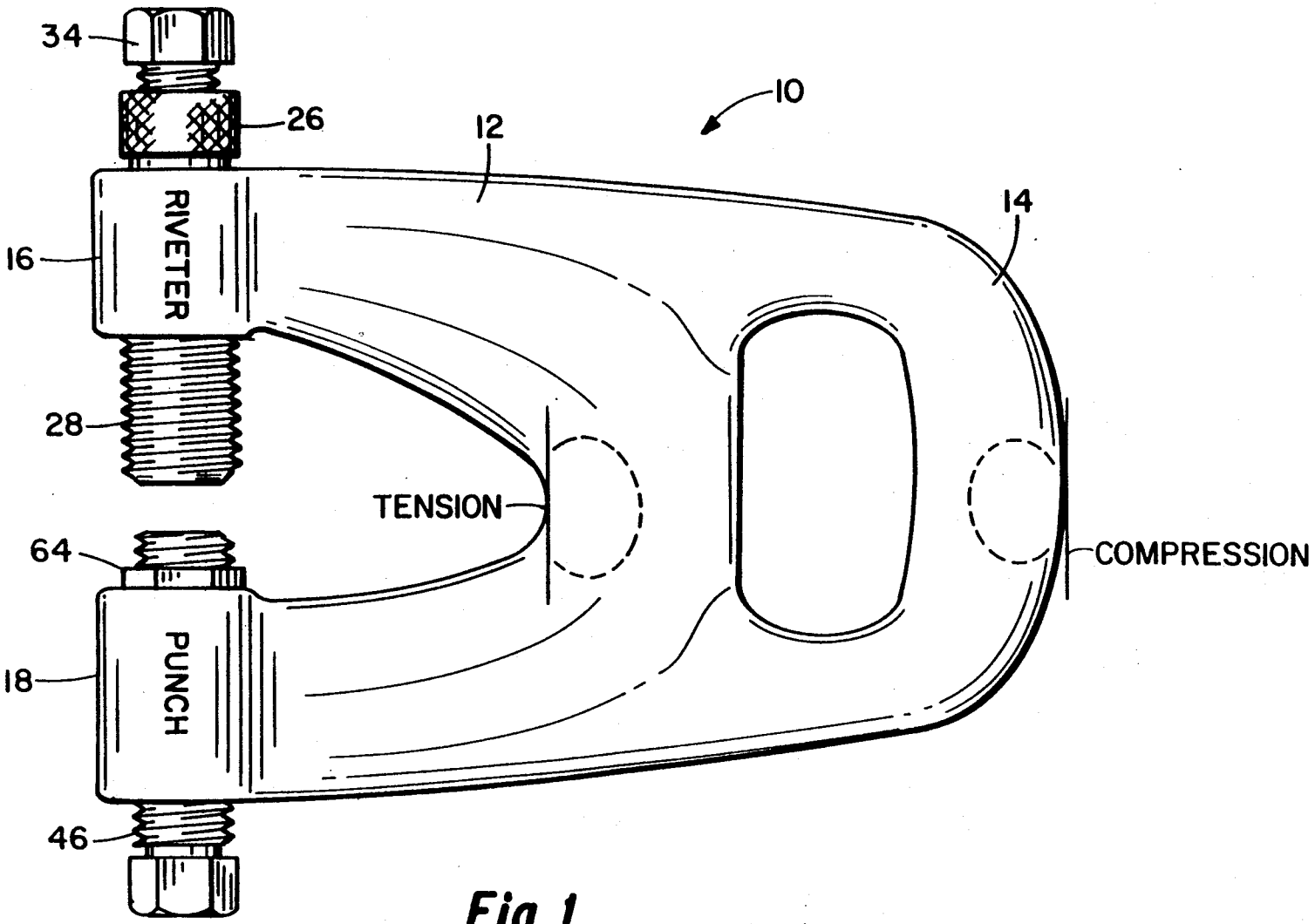
FIG. 1 is a side elevational view of a hand tool embodying the present invention.
Figure 2:
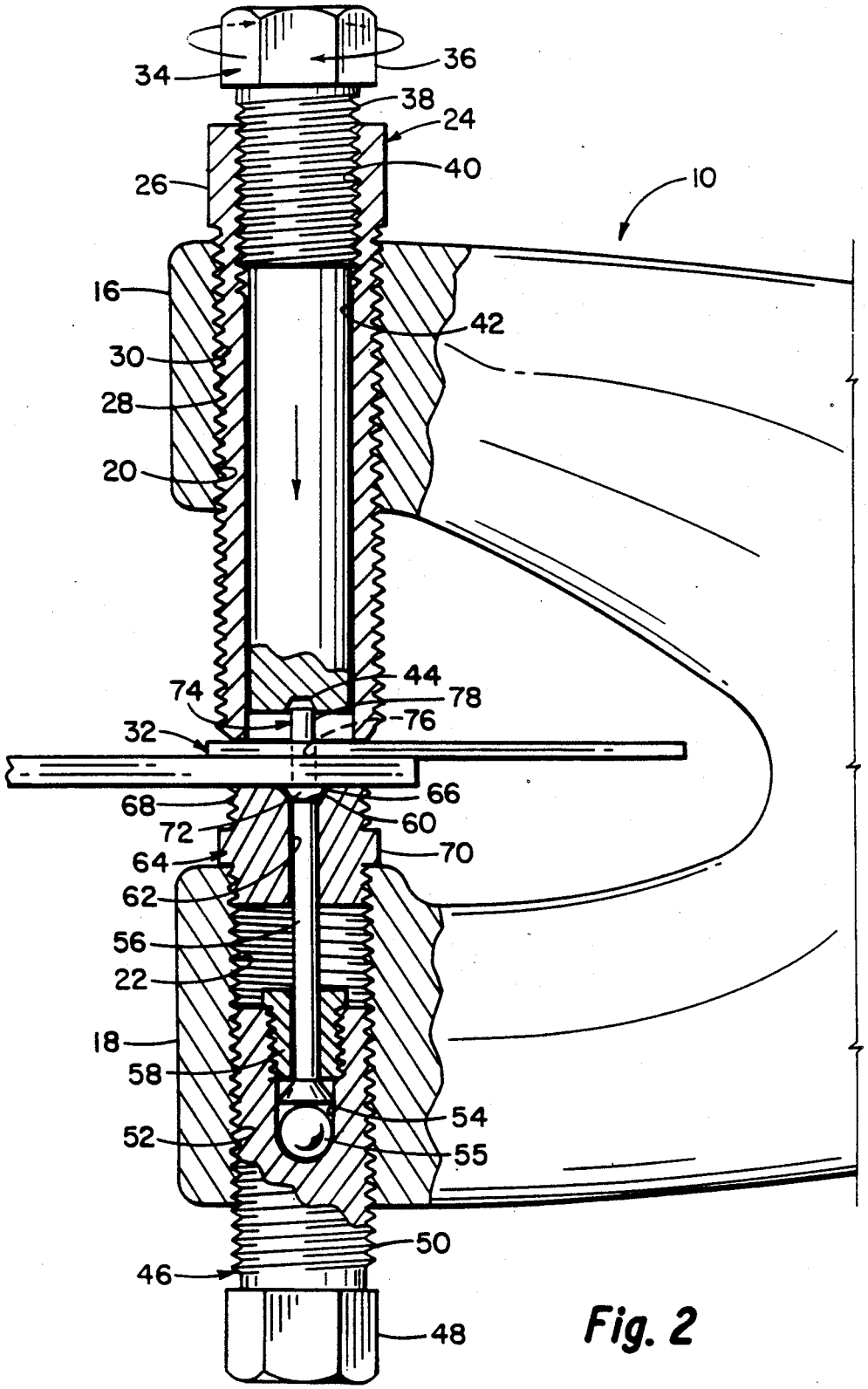
FIG. 2 is a side elevational view of a hand tool, embodying the present invention, in the process of installing a rivet into a workpiece.

As shown in FIG. 1, a hand tool 10 of the present invention is formed from one or more pieces to produce a generally C-shaped body 12, which can include an integral handle 14. Generally parallel end portions 16 and 18, as shown in FIGS. 1 and 2, extend from the body 12 and both include bores 20 and 22, respectively, therethrough which are coaxially aligned.

Some of the peculiar benefits of the configuration shown in the figures is that it permits a tool to have a single end for both riveting and punching out rivets, whereas alternative designs have a riveter on one end and a punch on the lateral opposite end which is much more costly and basically requires stress structure on each end which adds weight. Further, each function is in two separate tools.

One prior design does not use optimum stress design as one set of screws is closer to the throat of the "C" than the other and a minimum clearance distance is needed. Also, the structure must be strong enough to support the end screw assembly.

The present invention has one clamp used for both riveting and punching which saves a second clamp, also the punch end and punch guide needed for punching out rivets also seconds as the rest for riveting, again double use of the same parts. The "D" shaped tool as shown in the enclosed materials is structurally ideal with a tension in the middle of the "C" and compression ideally located out some distance in the handle area.

A tubular clamp sleeve 24 has a knurled head 26 on an outer end thereof, and includes threads 28 on at least a portion of the exterior of the clamp sleeve 24 to cooperate with threads 30 within the bore 20. By rotation of the head 26, the clamp sleeve 24 is reciprocally moved away from or towards the second end portion 18 to secure a workpiece 32 therebetween, as will be described below. A rivet forming screw 34 has a bolt head 36 on an outer end thereof, and includes threads 38 on at least a portion of the exterior thereof to cooperate with threads 40 within a coaxial bore 42 within the clamp sleeve 24. An inner end of the rivet forming screw 34 has a hardened concave surface 44 for abutting and mallably deforming a shank of a rivet, as will be described below. Another clamping and rivet forming structure that can be used place of or portions adapted to be used with that described above, is shown and described in U.S. Pat. No. 3,230,751.

A punch screw 46 has a bolt head 48 on an outer end thereof, and includes threads 50 on at least a portion of the exterior thereof to cooperate with threads 52 within the bore 22. The punch screw 46 includes a recess 54 into which is received a ball 58 and an outer end of a punch member 56 retained by retainer 58. The punch member 56 has an elongated shaft with a hardened end 60 which passes through a bore 62 in a punch guide 64. The punch guide 64 can be formed as part of the second end portion 18, or can be formed from a removable, separate member as is shown. Another punch member that can be used in place of or portions adapted to be used with that described above, is shown and described in U.S. Pat. No. 3,412,597 and 3,234,634. Specifically, the punch guide 64 has an inner end with a concave cross-section 66 adapted to receive thereinto the head of a rivet, as will be described below. The punch guide 64 can also be reversible by including threads 68 on either side of an annular shoulder 70, and cooperable with the threads 52 within the bore 22. On an end opposite from the concave cross-section 66 can be any other desired configuration, such as convex or flat.

As shown in FIG. 2, a workpiece 32 with two separate sections to be secured together is placed between the end portion 16 and 18. The punch guide 64 has been inserted so that the desired rivet-style anvil will be facing inwardly. The punch end 60 is slightly retracted by rotation of the punch screw 46 to provide a concave anvil area to receive a head 72 of a rivet 74 that extends through a bore 76 in the workpiece 32 and with a shank 78 extending out therefrom. The clamp sleeve 24 is rotated until an inner end thereof presses the workpiece 32 (and the rivet head 72) against the punch guide 64 to secure the hand tool 10 to the workpiece 32. The rivet forming screw 34 is rotated to force the concave surface 44 onto the shank 78 to mallably deform the shank 78, and thus secure the two sections of the workpiece 32. Thereafter, the clamp sleeve 24 is rotated to release the hand tool 10 from the workpiece 32.

Figure 3:
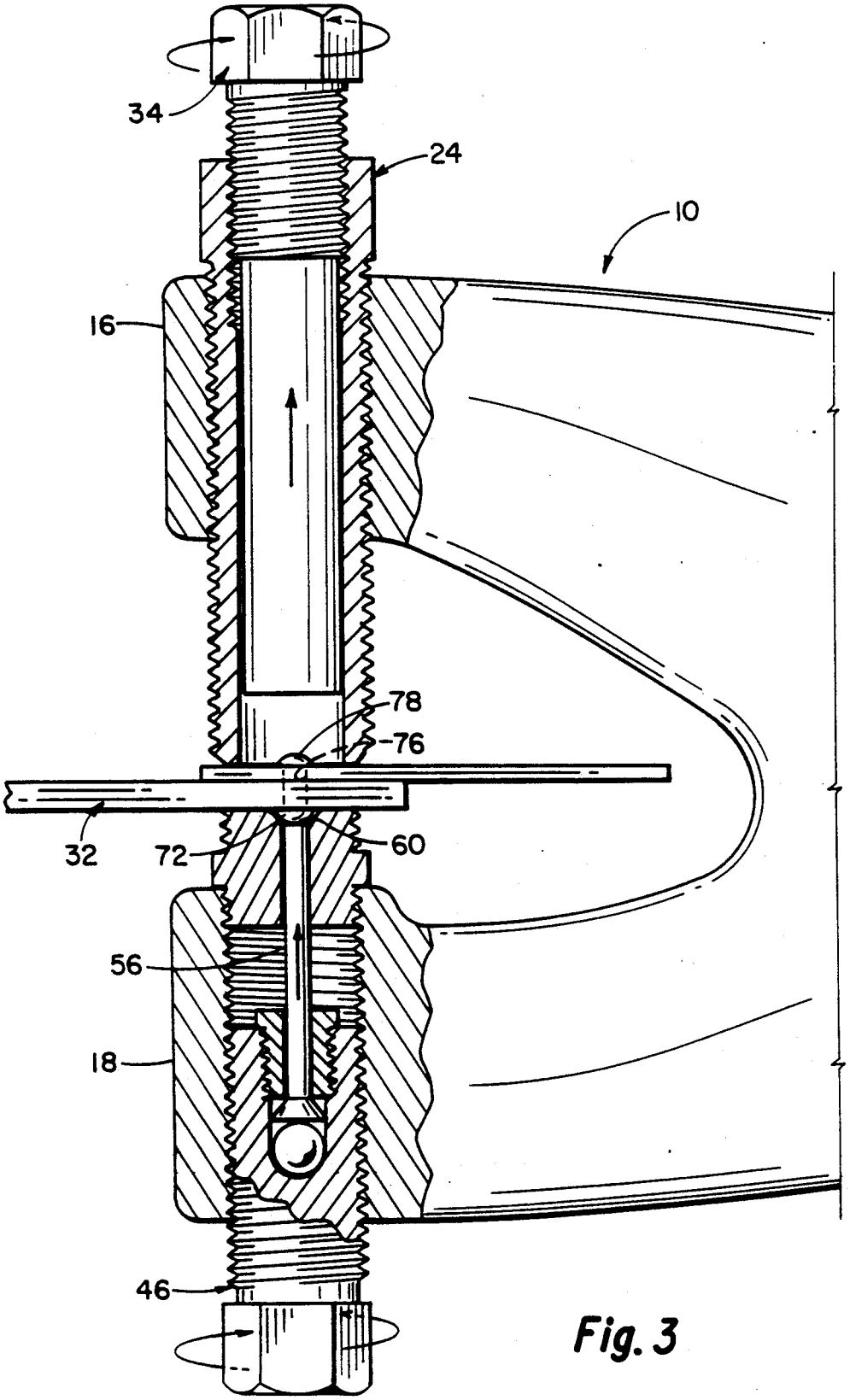
FIG. 3 is a side elevational view of the hand tool of FIG. 2 in the process of removing a rivet from a workpece.

As shown in FIG. 3, when the rivet 74 is to be removed from the workpiece 32, the some procedure as above applies, but the rivet forming screw 34 is slightly retracted within the clamp sleeve 24. Then, the punch screw 46 is rotated to force the hardened end 60 out through the punch guide 64 and into contact with the rivet 74 to be removed. Further rotation of the punch screw 46 causes the hardened end 60 to destroy the rivet 74 and force it out of the bore 76. Thereafter, the punch screw 46 is rotated to retract the punch member 56 and the clamp sleeve 24 is rotated to release the hand tool 10 from the workpiece 32.

The configuration of the present invention takes advantage of desirable features of both punches and rivet formers and combines these in a coaxial, and unique, manner to provide a single tool that can be less expensive, lighter and smaller than all prior tools.

Whereas the present invention has been described in relation to the drawings attached hereto, and it should be understood that other and further modifications, apart from those shown or suggested herein, may be made within the scope and spirit of the present invention.

What is claimed is:

1. A hand tool for both installing and removing mallable rivets, comprising:

a generally C-shaped body including generally parallel first and second portions;

a clamp sleeve extending through a bore in the first end portion;

a rivet forming member extending coaxially through a longitudinal bore in the clamp sleeve;

a punch member extendable through a bore in the second end portion, the bore in the first end portion and the bore in the second end portion being coaxially aligned;

the clamp sleeve adapted to press a workpiece against a punch guide portion of the second end portion;

the rivet forming screw adapted to form a rivet from a rivet end extending outwardly from the workpiece while a head portion of the rivet is received into the punch guide portion; and the punch member adapted to extend through the punch guide portion to engage a head portion of the rivet and remove the rivet from the workpiece.

2. A hand tool of claim 1 wherein the clamp sleeve includes external threads adapted to cooperate with threads within the bore in the first end portion, and an outer end portion of the clamp sleeve including means for interconnection to a source of rotational movement.

3. A hand tool of claim 1 wherein the rivet forming member comprises a rivet forming screw having external threads adapted to cooperate with threads within the bore in the clamp sleeve, an outer end portion of the rivet forming screw including means for interconnection to a source of rotational movement, and an inner end portion having an indentation adapted to receive and deform an end portion of a rivet extending from the workpiece.

4. A hand tool of claim 1 wherein the punch member includes external threads adapted to cooperate with threads within the bore in the second end portion, and an outer end portion of the punch member including means for interconnection to a source of rotational movement.

5. A hand tool of claim 4 wherein the punch member comprises a punch screw having a punch shaft extending outwardly therefrom and through a bore in the punch guide portion.

6. A hand tool of claim 1 wherein the punch guide portion comprises a removable anvil having threads on an outer portion thereof adapted to cooperate with threads within the bore of the second end portion.

7. A hand tool of claim 6 wherein the removable anvil includes an annular shoulder adapted to abutt against an outer edge of the bore in the second end portion, a first end of the anvil having a generally concave cross-sectional profile, and a second opposite end of the anvil having a generally flat cross-sectional profile.

* * * * *